US012612718B2

(12) United States Patent
Wang

(10) Patent No.: US 12,612,718 B2
(45) Date of Patent: Apr. 28, 2026

(54) WOVEN WARP-KNIT-LIKE FABRIC

(71) Applicant: ADVANCE DENIM CO., LTD., Foshan (CN)

(72) Inventor: Zongwen Wang, Foshan (CN)

(73) Assignee: ADVANCE DENIM CO., Ltd, Guangdong (CN)

( * ) Notice: Subject to any disclaimer, the term of this patent is extended or adjusted under 35 U.S.C. 154(b) by 810 days.

(21) Appl. No.: 17/914,847

(22) PCT Filed: Mar. 31, 2020

(86) PCT No.: PCT/CN2020/082430
§ 371 (c)(1),
(2) Date: Sep. 27, 2022

(87) PCT Pub. No.: WO2021/195962
PCT Pub. Date: Oct. 7, 2021

(65) Prior Publication Data
US 2023/0144350 A1 May 11, 2023

(51) Int. Cl.
*D03D 15/30* (2021.01)
*D03D 15/217* (2021.01)
*D03D 17/00* (2006.01)

(52) U.S. Cl.
CPC ..... *D03D 17/00* (2013.01); *D03D 15/217* (2021.01); *D03D 15/30* (2021.01)

(58) Field of Classification Search
CPC ..... D03D 11/00; D03D 13/004; D03D 15/00; D03D 15/56; Y10T 442/3915; Y10T 442/3203
See application file for complete search history.

(56) References Cited

U.S. PATENT DOCUMENTS

2016/0024692 A1* 1/2016 Yung ..... D03D 15/56 139/421
2019/0119835 A1* 4/2019 Yenici ..... D03D 15/567

FOREIGN PATENT DOCUMENTS

CN 208362589 U * 1/2019
WO PCT/CN2019/105244 9/2019

OTHER PUBLICATIONS

Espacenet translation of CN-208362589-U. (Year: 2019).*

* cited by examiner

*Primary Examiner* — Marla D Mcconnell
*Assistant Examiner* — Christine X Nisula

(57) ABSTRACT

A woven warp-knit-like fabric, includes a first warp yarn, a second warp yarn, a third warp yarn, and a weft yarn; the first warp yarn is interwoven with the weft yarn to form a surface layer of a fabric, the second warp yarn is interwoven with the weft yarn to form a middle layer of the fabric, and the third yarn is interwoven with the weft yarn to form an inner layer of the fabric; at least three weft weave points are provided between two adjacent groups of warp weave points on the third warp yarn; the first warp yarn is a non-elastic yarn, the third warp yarn is an elastic yarn or a non-elastic yarn, and elastic properties of the second warp yarn are greater than those of the first warp yarn and the third warp yarn.

10 Claims, 2 Drawing Sheets

WOVEN WARP-KNIT-LIKE FABRIC

TECHNICAL FIELD

This invention generally relates to the technical field of fabric, and more particularly, to a woven warp-knit-like fabric.

BACKGROUND

Along with the social progress and the improvement of living standards, people have higher demands on clothes. Presently, people pursue the comfort other than leisure, fitness and style of clothes. Therefore, a fabric that resembles traditional jeans in appearance and is soft, thin, comfortable, breathable and elastic is wanted by the market.

The woven fabric does not easily droop when be hung and has a stable construction, a smooth cloth surface and a variety of styles and looks. These advantages make the woven fabric suitable for various cutting methods. However, compared with knitted fabric, its air permeability, hand feeling and other performances are poor.

With the rapid development of knitting technology, the loop construction of knitted fabric has made high wearability possible. Therefore, weft knitted jean fabric appears in the market. Unfortunately, although the weft knitted jean fabric has ideal weft extensibility, its poor dimensional stability fails to meet the market demand.

The construction and appearance style of warp-knitted fabric significantly differ from those of weft-knitted fabric. Warp-knitted fabric possesses merits such as less laddering, high firmness and high dimensional stability. By means of the adjustment of raw materials, weave constructions and after-finish processes, a strong visual impact of the fabric is achieved. However, the warping and weaving of warp-knitted fabric have high requirements on the strength and elongation of yarns. In production, chemical fibers are normally used instead of staple fibers (e.g., cotton fibers) for yarn spinning. Because the strength of yarns made of staple fibers is not as strong as polyester, polyamide and other chemical fibers, the mechanical properties of cotton yarn may easily be damaged due to the tension fluctuation during warping and weaving. Moreover, the yarns made of staple fibers inevitably contain filoplume and neps, and the tangling and accumulation of filoplume and neps during the warp-knitting and weaving may cause the breakage of yarn due to the blockage of yarn sleys and guide needles. As a result, the production process has high requirements on filoplume and yarn strength. It is difficult for coarse yarns and yarns made of staple fibers to meet these requirements, severely restricting the appearance style of warp-knitted fabric.

Therefore, patent PCT/CN/2019/105244 discloses a woven warp-knit-like fabric, wherein two kinds of yarns with the same or different shrinkage rates are used in the warp-backed weave, a non-elastic inner warp yarn is wound on the back of the fabric for a certain length, and an elastic surface warp yarn shrinks to enable the inner warp yarn to form loops with a certain radian on the back of the fabric. In this way, the fabric has the appearance style of a woven fabric, and also has the characteristics of good air permeability and good hand feeling of a warp-knitted fabric.

However, in the aforesaid weave construction, the surface warp yarn has high elasticity, resulting in the following problems:

1. Because the warping process is mainly for stretching the surface warp yarns, if the tension of some warp yarns is not enough during stretching, the elastic yarns may bounce back and shrink together; meanwhile, an excessive control of the tension may reduce the elasticity of the elastic yarns, failing to achieve a uniform tension of yarns during warping; under such circumstances, a large amount of work is needed for adjusting the yarn count sizes, twist degrees and elastic forces, which leads to low production efficiency; in warping process, the yarns are easy to break, and for elastic yarns, a phenomenon called "reversely-twisted yarns" may easily occur due to broken warp yarns, namely, the yarns being wound together due to elastic shrinkage after breakage; especially, the yarns with high elasticity, large English yarn count and high twist degree are difficult to straighten after shrinking and winding, which severely affects the warping effect;
2. When dyeing in a dyeing-sizing machine, the yarns need to pass through many guide rollers, and the tension of yarns is controlled by the guide rollers; therefore, it is difficult to ensure a uniform tension, resulting in different stretch lengths of elastic yarns, uneven dyeing of yarns, color difference and even the phenomenon of "reversely-twisted yarns";
3. The elastic filaments in the elastic yarn are normally uncolored; when the yarn is stretched or woven, the surface of the yarn is easy to wear, which causes the exposure of the yarn core, seriously affecting the quality of the fabric; moreover, this process requires a manual color correction, resulting in high labor cost.

Therefore, it is urgent for those skilled in the art to develop a weave construction.

SUMMARY

The purpose of the present invention is to provide a woven warp-knit-like fabric. According to the present invention, the difficulty of warping caused by using an elastic yarn as a surface layer warp yarn is solved, a color difference during dyeing is avoided, and a manual color correction treatment becomes unnecessary.

To achieve the above purpose, the present invention adopts the following technical solution:

A woven warp-knit-like fabric of the present invention, comprising a first warp yarn, a second warp yarn, a third warp yarn, and a weft yarn; the first warp yarn is interwoven with the weft yarn to form a surface layer of a fabric, the second warp yarn is interwoven with the weft yarn to form a middle layer of the fabric, and the third yarn is interwoven with the weft yarn to form an inner layer of the fabric; at least three weft weave points are provided between two adjacent groups of warp weave points on the third warp yarn, and the number of each group of warp weave points is at least one; the first warp yarn is a non-elastic yarn, the third warp yarn is an elastic yarn or a non-elastic yarn, and the elastic properties of the second warp yarn are greater than those of the first warp yarn and the third warp yarn.

In another embodiment of the present invention, in the woven warp-knit-like fabric, 4-16 weft weave points are arranged between two adjacent groups of warp weave points on the third warp yarn.

In another embodiment of the present invention, in the woven warp-knit-like fabric, the arrangement ratio of the first warp yarn to the third warp yarn is 1:5-4:1, and the arrangement ratio of the first warp yarn to the second warp yarn is 1:4-3:1.

In another embodiment of the present invention, in the surface layer and middle layer of the woven warp-knit-like fabric, there are 1-7 warp weave points where the warp yarn and weft yarn are interwoven.

In another embodiment of the present invention, in the woven warp-knit-like fabric, the surface layer and middle layer are a 1/1 plain weave or the number of basic weave cycles is 3-8.

In another embodiment of the present invention, in the woven warp-knit-like fabric, the surface layer and middle layer are a plain weave, twill weave or satin weave.

In another embodiment of the present invention, in the woven warp-knit-like fabric, 7-13 weft weave points are arranged between two adjacent groups of warp weave points on the third warp yarn.

In another embodiment of the present invention, the first warp yarn is a yarn made of a staple fiber. The second warp yarn is one of an elastic core spun yarn prepared by wrapping an elastic yarn with a staple fiber, a filament yarn with elasticity, and an elastic core spun yarn prepared by wrapping an elastic yarn with a filament yarn. The third warp yarn is one of a yarn made of a staple fiber, a core spun yarn prepared by wrapping an elastic yarn with a staple fiber, and a core spun yarn prepared by wrapping a non-elastic filament yarn with a staple fiber.

In another embodiment of the present invention, when the first warp yarn or the third warp yarn is made of a staple fiber, the yarn count ranges from 6S to 60S. When the third warp yarn is a core spun yarn prepared by wrapping an elastic yarn with a staple fiber, the yarn count ranges from 6S to 60S, and the yarn count of the elastic yarn ranges from 20D to 300D. When the third warp yarn is a core spun yarn prepared by wrapping a non-elastic filament yarn with a staple fiber, the yarn count ranges from 6S to 60S. When the second warp yarn is an elastic core spun yarn prepared by wrapping an elastic yarn with a staple fiber, the whole yarn count ranges from 6S to 60S, and the yarn count of the elastic yarn ranges from 20D to 300D. When the second warp yarn is a filament yarn with elasticity, the yarn count ranges from 20D to 450D, and when the second warp is an elastic core spun yarn prepared by wrapping an elastic yarn with a filament yarn, the whole yarn count ranges from 40D to 600D, and the yarn count of the elastic yarn ranges from 20D to 300D.

In another embodiment of the present invention, in the woven warp-knit-like fabric, the English yarn count of the third warp yarn is the same as that of the first warp yarn, or the English yarn count of the third warp yarn is greater than that of the first warp yarn.

In another embodiment of the present invention, in the woven warp-knit-like fabric, the first warp yarn is cotton, and its yarn count ranges from 8S to 38S. The second warp yarn is an elastic core spun yarn prepared by wrapping an elastic yarn with a filament yarn, the whole yarn count ranges from 50D to 150D, and the yarn count of the elastic yarn ranges from 20D to 105D. The third warp yarn is made of a staple fiber, and the yarn count ranges from 16S to 60S. Alternatively, the third warp yarn made of a filament yarn, and the yarn count ranges from 50D to 450D.

Compared with the prior art, the present invention has the following advantages:

The present invention provides a woven warp-knit-like fabric. Through optimizing the weave construction, high quality, high strength and high filling power of the fabric are ensured. The surface of the fabric is fluffy and light, achieving good air permeability, good hand feeling and ideal wearing comfort. Because the first warp yarn adopts a non-elastic yarn, compared with the prior art, it is easier to control the yarn tension during warping while avoiding the phenomenon of reversely-twisted yarn after its breakage. Therefore, the warping becomes easier and the production efficiency becomes higher. When dyeing, the color difference caused by an excessive difference between the tensile elongation of each first warp yarn is effectively avoided. By means of this design, even if the surface of the first warp is worn, an exposure of yarn core is avoided and a manual color correction becomes unnecessary. Thus, the labor cost is significantly reduced.

DETAILED DESCRIPTION

To make the purpose, technical solution and effect of the present invention clearer, embodiments are combined hereinafter to elaborate the present invention. It should be understood that the specific embodiments described herein are merely used to explain but not limit the present invention.

Figure 1:
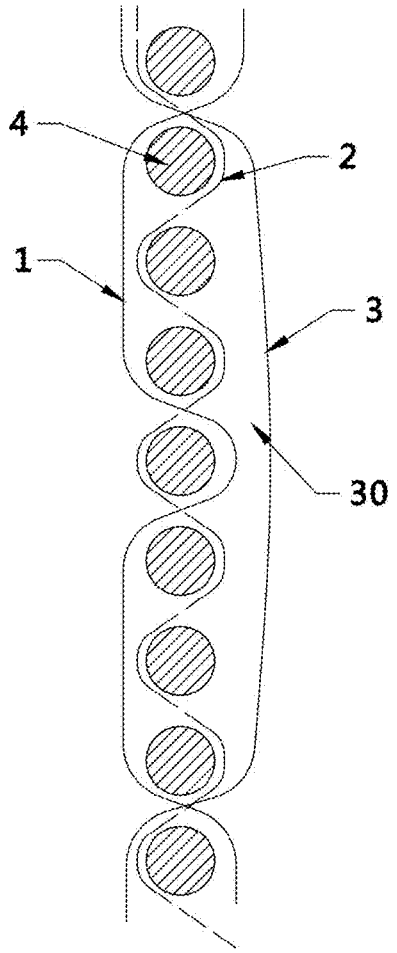
FIG. 1 is a conceptual diagram illustrating a fabric construction of the woven warp-knit-like fabric of the present invention.

Referring to FIG. 1, a woven warp-knit-like fabric of the present invention, comprising a first warp yarn 1, a second warp yarn 2, a third warp yarn 3, and a weft yarn 4; the first warp yarn 1 is interwoven with the weft yarn 4 to form a surface layer of a fabric, the second warp yarn 2 is interwoven with the weft yarn 4 to form a middle layer of the fabric, and the third yarn 3 is interwoven with the weft yarn 4 to form an inner layer of the fabric; at least three weft weave points are provided between two adjacent groups of warp weave points on the third warp yarn 3, and the number of each group of warp weave points is at least one; the first warp yarn 1 is a non-elastic yarn, the third warp yarn 3 is an elastic yarn or a non-elastic yarn, and the elastic properties of the second warp yarn 2 are greater than those of the first warp yarn 1 and the third warp yarn 3.

It is worth mentioning that, the first, second and third warp yarns are used merely for the convenience of description, which do not necessarily represent the number of warp yarns and weft yarns.

The first warp yarn 1 and the weft yarn 4 are interwoven to form a front surface of the fabric, and the front surface of the fabric may be designed according to different styles, for example, a 3/1 twill weave, which is a classical jean style. The third warp yarn 3 and the weft yarn 4 are interwoven to form a rear surface of the fabric, by means of the weft weave points continuously arranged on the rear surface, the tightness of the fabric decreases after the third warp yarn 3 and the weft yarn 4 are interwoven, and the fabric is easy to be compressed, which significantly improve the air permeability, hand feeling and filling power of the fabric. The second warp yarn 3 and the weft yarn 4 are interwoven to form a middle layer between the surface layer and the inner layer of the fabric, which makes the hand feeling good while propelling the third warp yarn to contract to form loops with a certain radian. Referring again to FIG. 1, there are air storage spaces 30 formed between the third warp yarn 3 and the weft yarn 4, which makes the rear surface of the fabric feel soft, breathable and fluffy. Therefore, the rear surface of the fabric of the present invention has high comfort when contacting with the skin. In addition, because the first warp yarn adopts a non-elastic yarn, it is easier to make the yarn tension uniform during warping, and the phenomenon of reversely-twisted yarn after the yarn breakage is avoided. In this way, the warping process becomes smooth and the production efficiency is improved. Moreover, when dyeing, the color difference caused by an excessive difference between the tensile elongation of each first warp yarn is effectively avoided. By means of this design, even if the surface of the first warp is worn, an exposure of yarn core is avoided and a manual color correction becomes unnecessary. Thus, the labor cost is significantly reduced.

In actual use, for the conventional warp-knit-like fabric with a double-weave construction, the elastic performance of the surface yarn is easily damaged due to a prolonged stress formed at knees, elbows, hips and other parts of human bodies, which directly leads to the formation of bulges, failing to achieve tight and comfortable feeling. In the three-layer construction of the present invention, the second warp yarn has elasticity, capable of providing an elastic force in the warp direction while being stretched under the elastic force. The first warp yarn does not have elasticity, and therefore when being interwoven with the weft yarn, the front surface of the fabric is tightly interwoven, so that the fabric at knees, elbows, hips and other parts is close and tight. In this way, the appearance of the fabric is not affected by the bulges caused by the variation of yarn elasticity. Especially, for parts such as hips and abdomens, due to the tightness of the front surface of the fabric and the elasticity of the second layer, the fabric of the present invention plays a good role in hip lifting and body slimming. Through adopting the present invention, the tightness and comfort of the fabric as well as the effects of hip lifting and body slimming are achieved, and the formation of bulges caused by the variation of yarn elasticity is avoided.

In some preferred embodiments, 4-16 weft weave points are arranged between two adjacent groups of warp weave points on the third warp yarn 3. Because the fabric undergoes treatments such as de-sizing, soda boiling and washing during post finishing, when weft weave points are too many, the yarn fibers that are not interwoven between the warp yarns and weft yarns become loose. Meanwhile, the increased filoplume on the yarn surface damages the yarn strength. Even worse, the yarns may be tangled together. In daily wear, the rear surface of the fabric contacts and rubs with the skin, worsening the tangling of yarns such that the appearance style and hand feeling of the fabric are severely affected. When weft-weave points are too few, the warp yarns and weft yarns on the rear surface of the fabric are tightly interwoven, so that the fabric is not easy to be stretched. As a result, some parts of human bodies are stressed and feel squeezed, resulting in poor wearing experience. In the present invention, 4-16 weft weave points are arranged between two adjacent groups of warp weave points on the third warp yarn 3, which achieves a proper tightness, effectively preventing the yarns from being tangled together.

Preferably, the arrangement ratio of the first warp yarn to the third warp yarn is 1:5-4:1, and the arrangement ratio of the first warp yarn to the second warp yarn is 1:4-3:1.

In some embodiments, the number of complete weave cycles of warp yarns of the fabric is equal to the sum of the least common multiple of the number of basic weave cycles of warp yarns and the arrangement ratio, and the number of complete weave cycles of warp yarns is equal to the least common multiple of the number of basic weave cycles of warp yarns.

In some preferred embodiments, in the surface layer and middle layer of the fabric, there are 1-7 warp weave points where the warp yarn and weft yarn are interwoven. In this way, the front surface of the fabric exhibits a woven style, endowing the fabric with an appearance of traditional jeans.

The surface layer and middle layer may adopt a plain weave, twill weave or satin weave. Specifically, the surface layer and middle layer may adopt a 1/1 plain weave or the number of basic weave cycles is 3-8.

In some preferred embodiments, 7-13 weft weave points are arranged between two adjacent groups of warp weave points on the third warp yarn. The non-elastic yarn may be any non-elastic yarns in the prior art, such as cotton yarn, chemical fiber elastic yarn, Tencel, Modal, wool yarn, Tencel cotton blended yarn and cotton Modal blended yarn, etc. The elastic yarn may be any elastic yarns in the prior art, such as a single core spun yarn and a double core spun yarn. More specifically, the elastic yarn may be cotton wrapped Lycra, cotton wrapped polyester wrapped Lycra, cotton wrapped chemical fiber elastic yarn wrapped Lycra, and cotton wrapped chemical fiber elastic yarn, etc.

Further, the first warp yarn 1 may be a yarn made of a staple fiber. The second warp yarn 2 may be one of an elastic core spun yarn prepared by wrapping an elastic yarn with a staple fiber, a filament yarn with elasticity, and an elastic core spun yarn prepared by wrapping an elastic yarn with a filament yarn. The third warp yarn 3 may be one of a yarn made of a staple fiber, a core spun yarn prepared by wrapping an elastic yarn with a staple fiber, and a core spun yarn prepared by wrapping a non-elastic filament yarn with a staple fiber. The staple fiber may be a cotton fiber, hemp fiber, Tencel, Modal, acrylic fiber, viscose, rayon, polyester, nylon and sea island filament, etc. Preferably, the staple fiber is cotton fiber.

When the first warp yarn 1 or the third warp yarn 3 is made of a staple fiber, the yarn count ranges from 6S to 60S. When the third warp yarn 3 is a core spun yarn prepared by wrapping an elastic yarn with a staple fiber, the yarn count ranges from 6S to 60S, and the yarn count of the elastic yarn ranges from 20D to 300D. When the third warp yarn 3 is a core spun yarn prepared by wrapping a non-elastic filament yarn with a staple fiber, the yarn count ranges from 6S to 60S. When the second warp yarn 2 is an elastic core spun yarn prepared by wrapping an elastic yarn with a staple fiber, the whole yarn count ranges from 6S to 60S, and the yarn count of the elastic yarn ranges from 20D to 300D. When the second warp yarn 2 is a filament yarn with elasticity, the yarn count ranges from 20D to 450D, and when the second warp 2 is an elastic core spun yarn prepared by wrapping an elastic yarn with a filament yarn, the whole yarn count ranges from 40D to 600D, and the yarn count of the elastic yarn ranges from 20D to 300D.

In some preferred embodiments, the English yarn count of the third warp yarn 3 is the same as that of the first warp yarn 1, or the English yarn count of the third warp yarn 3 is greater than that of the first warp yarn 1. When the average size of yarns on the rear surface of the fabric is larger than that of yarns on the front surface, the appearance style of the front surface of the fabric may be severely affected, resulting in poor wale clearness of the fabric. Therefore, the English yarn count of the third warp yarn 3 is greater than or equal to that of the first warp yarn 1 (namely, the size of the third warp yarn 3 is not greater than that of the first warp yarn 1).

In this way, the wale clearness of the front surface of the fabric is further improved. For example, the first warp yarn is cotton, and its yarn count ranges from 8S to 38S. The second warp yarn is an elastic core spun yarn prepared by wrapping an elastic yarn with a filament yarn, the whole yarn count ranges from 50D to 150D, and the yarn count of the elastic yarn ranges from 20D to 105D. The third warp yarn is made of a staple fiber, and the yarn count ranges from 16S to 60S. Alternatively, the third warp yarn made of a filament yarn, and the yarn count ranges from 50D to 450D.

The weft yarn 4 may be a yarn made of a staple fiber or a filament yarn. When the first weft yarn is made of a staple fiber, the yarn count ranges from 6S to 60S, and when the weft yarn 4 is made of a filament yarn, the yarn count ranges from 40D to 600D. If the weft yarn has elasticity, it may be an elastic core spun yarn prepared by wrapping an elastic yarn with a staple fiber (e.g., a spandex yarn wrapped with a staple fiber) or an elastic core spun yarn prepared by wrapping an elastic yarn with a filament yarn. If the weft yarn is an elastic core spun yarn prepared by wrapping an elastic yarn with a staple fiber, the whole yarn count ranges from 6S to 60S, and the yarn count of the elastic yarn ranges from 20D to 300D. The weft yarn may be a single core spun yarn or a double core spun yarn, for example, a cotton yarn wrapped with spandex, a cotton yarn wrapped with polyester and a cotton yarn wrapped with chemical fiber elastic yarn, etc. The optional scope of the second weft yarn is the same as that of the first weft yarn.

The woven warp-knit-like fabric of the present invention has the following advantages:

1. The fabric has the appearance style of a woven fabric, and also has the characteristics of good air permeability and good hand feeling of a warp-knitted fabric;
2. The fabric surface is fluffy and light; the woven warp-knit-like fabric adopts a structure with three interwoven layers of warp yarns and weft yarns; under the action of the elasticity of the second warp yarn, a plurality of loops with a certain radian are formed by the third warp yarn on the reverse surface of the fabric, thereby forming more air storage spaces; compared with fabrics with the same thickness, the weight of the woven warp-knit-like fabric is lower and the hand feeling is better;
3. Because the first warp yarn is a non-elastic yarn, when it is dyed, its color absorption is sufficient, effectively avoiding the color difference occurring when dyeing the outer surface of the fabric;
4. The color of warp yarns on both surfaces may be the same or different, achieving a stronger expression of fashion, enabling designers to design freely and allowing consumers to achieve more wearing styles with one piece of clothes;
5. The fabric has a good hand feeling; the present invention adopts a special weave construction; the loops with a certain radian on the rear surface of the fabric is vertically arranged; therefore, when the fabric rubs up and down with the skin, the loops with a certain radian are in the moving direction of the skin, facilitating the reduction of discomfort caused by the fabric.

The present invention is further described in the following embodiments:

Embodiment 1

Figure 2:
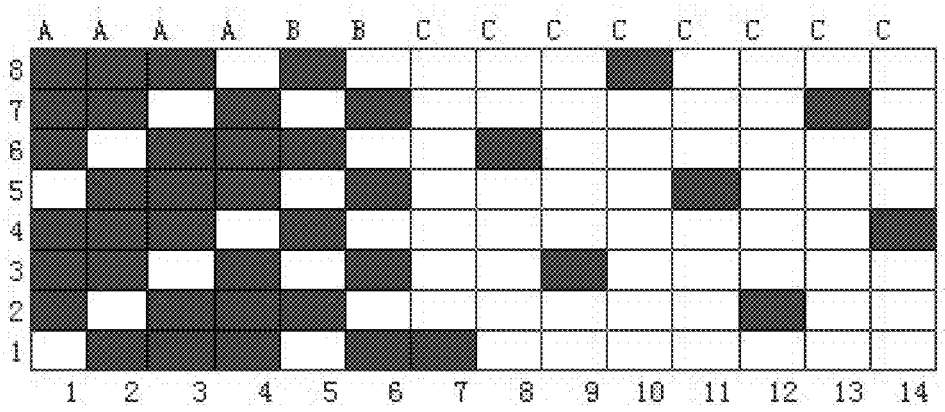
FIG. 2 is a conceptual diagram illustrating a fabric construction of the woven warp-knit-like fabric in embodiment 1 of the present invention.

FIG. 2 is a conceptual diagram illustrating a weave construction of the woven warp-knit-like fabric of the present invention.

In FIG. 2, the colored grids represent the warp weave points, and the blank grids represent the weft weave points. Area A of the fabric is a surface layer, and its weave construction is a 3/1 right twill. Area B is a middle layer, and its weave construction is a 1/1 plain weave. Area C is an inner layer, and its weave construction is a satin weave (R=8 and SW=5).

The healding method adopts the a flying healding. The healding method is: 1 5 7 2 6 8 3 5 9 4 6 10 1 5 11 2 6 12 3 5 13 4 6 14, and the reed-in method is 4 in one reed.

The first warp yarn: a pure cotton yarn having a yarn count of 8S is adopted, and the yarn color is indigo;

The second warp yarn: a yarn prepared by wrapping a 40D spandex with a 95D polyester is adopted;

The third warp yarn: a pure cotton yarn having a yarn count of 50S is adopted, and the yarn color is white;

The weft yarn: a core spun yarn prepared by wrapping 40D spandex with a 16S pure cotton yarn is adopted;

The reed count on the warp yarn is 62 reeds (4 in);

The weft yarn weaving density is 46 T;

The first warp yarn covering rate is 62/28 (8)=78%;

The third warp yarn covering rate is 62/28 (50)=31%.

After testing the performances of the woven warp-knit-like fabric in this embodiment after conventional post finishing, the test results are shown in the following table:

| | Recovery Rate | Elongation | Increase Rate | Stitch Slipping |
|---|---|---|---|---|
| Warp Direction | 23.5% | 13.2% | 2.3% | 0.32 |
| Weft Direction | 86.1% | 46.3% | 5.6% | 0.56 |

It can be seen from the above that, the air permeability of the fabric reaches 48.65 mm/s and the filling power reaches 322.26 $cm^3/g$, achieving good air permeability and high filling power. The data in the table shows that the fabric has good elasticity and high slipping-resistance. Meanwhile, a clear twill-weave pattern, a three-dimensional sense, and tightly interwoven warp and weft yarns are achieved. The novel design of the weave construction makes the handing feeling of the fabric soft and comfortable. When touching the skin, a skin-friendly, comfortable, soft and natural feeling of the fabric is achieved.

Embodiment 2

Figure 3:
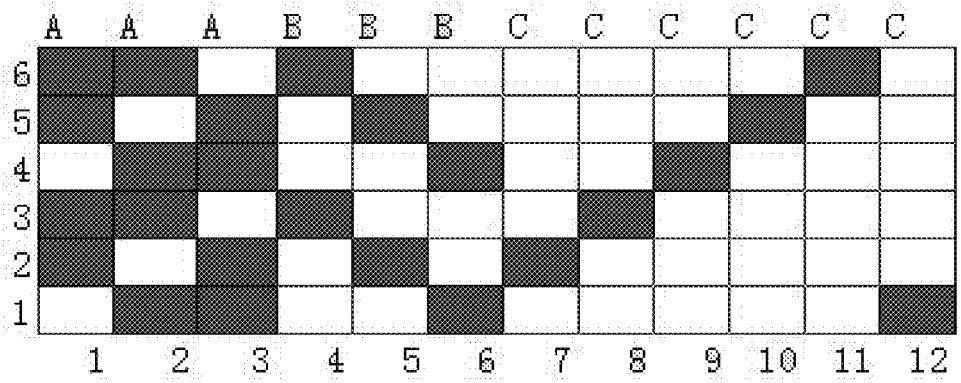
FIG. 3 is a conceptual diagram illustrating a fabric construction of the woven warp-knit-like fabric in embodiment 2 of the present invention.

FIG. 3 is a conceptual diagram illustrating a weave construction of the woven warp-knit-like fabric of the present invention.

In FIG. 3, the colored grids represent the warp weave points, and the blank grids represent the weft weave points. Area A of the fabric is a surface layer, and its weave construction is a 2/1 left twill. Area B is a middle layer, and its weave construction is a plain weave. Area C is an inner layer, and its weave construction is a 5/1 right twill satin weave.

The healding method adopts the a flying healding. The healding method is: 1 9 11 2 10 12 3 9 13 4 10 14 5 9 15 6 10 16 7 9 17 8 10 18, and the reed-in method is 4 in one reed.

The first warp yarn: a pure cotton slub yarn having a yarn count of 16S is adopted, and the yarn color is indigo;

The second warp yarn: a yarn prepared by wrapping a 70D spandex with a 50D nylon is adopted;

The third warp yarn: a Tencel cotton yarn having a yarn count of 50S is adopted, and the yarn color is white;

The weft yarn: a core spun yarn prepared by wrapping 70D spandex with a 21S pure cotton yarn is adopted;

The reed count on the warp yarn is 70 reeds (4 in);

The weft yarn weaving density is 52 T;

The first warp yarn covering rate is 70/28 (16)=62%;

The third warp yarn covering rate is 70/28 (50)=35%.

After testing the performances of the woven warp-knit-like fabric in this embodiment after conventional post finishing, the test results are shown in the following table:

| | Recovery Rate | Elongation | Increase Rate | Stitch Slipping |
|---|---|---|---|---|
| Warp Direction | 23.5% | 10.2% | 2.5% | 0.46 |
| Weft Direction | 91.2% | 51.2% | 4.1% | 0.42 |

It can be seen from the above that, the air permeability of the fabric reaches 36.58 mm/s and the filling power reaches 302.36 $cm^3/g$, achieving good air permeability and high filling power. The data in the table shows that the fabric has good elasticity and high slipping-resistance. Meanwhile, a clear twill-weave pattern, a three-dimensional sense, and tightly interwoven warp and weft yarns are achieved. The novel design of the weave construction makes the handing feeling of the fabric soft and comfortable. When touching the skin, a skin-friendly, comfortable, soft and natural feeling of the fabric is achieved.

Embodiment 3

Figure 4:
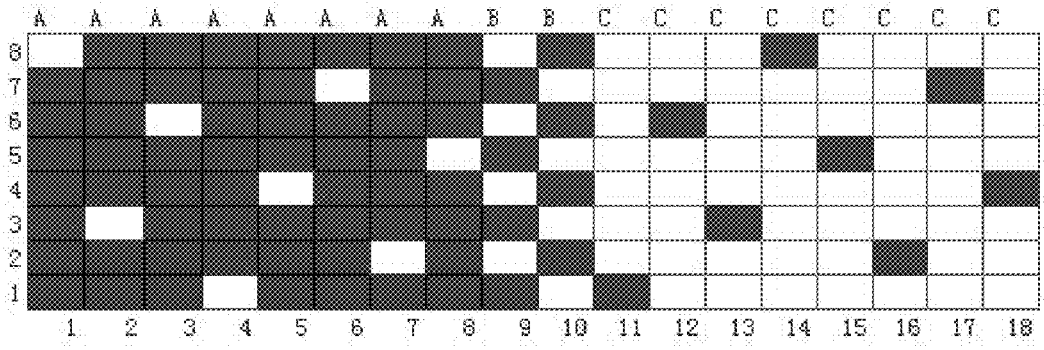
FIG. 4 is a conceptual diagram illustrating a fabric construction of the woven warp-knit-like fabric in embodiment 3 of the present invention.

FIG. 4 is a conceptual diagram illustrating a weave construction of the woven warp-knit-like fabric of the present invention.

In FIG. 4, the colored grids represent the warp weave points, and the blank grids represent the weft weave points. Area A of the fabric is a surface layer, and its weave construction is a warp satin weave (R=8 and SW=3). Area B is a middle layer, and its weave construction is a 1/1 plain twill. Area C is an inner layer, and its weave construction is a 5/1 weft right twill satin weave.

The first warp yarn: a pure cotton slub yarn having a yarn count of 21S is adopted, and the yarn color is sulfur black;

The second warp yarn: a yarn prepared by wrapping a 20D spandex with a 50D nylon is adopted;

The third warp yarn: a Tencel cotton yarn having a yarn count of 60S is adopted, and the yarn color is white;

The weft yarn: a core spun yarn prepared by wrapping 70D spandex with a 26S pure cotton yarn is adopted;

The reed count on the warp yarn is 82 reeds (4 in);

The weft yarn weaving density is 70 T;

The first warp yarn covering rate is 82/28 (21)=63%;

The third warp yarn covering rate is 82/28 (60)=37%.

After testing the performances of the woven warp-knit-like fabric in this embodiment after conventional post finishing, the test results are shown in the following table:

| | Recovery Rate | Elongation | Increase Rate | Stitch Slipping |
|---|---|---|---|---|
| Warp Direction | 36.5% | 15.8% | 3.2% | 0.56 |
| Weft Direction | 88.8% | 49.8% | 3.5% | 0.58 |

It can be seen from the above that, the air permeability of the fabric reaches 35.64 mm/s and the filling power reaches 289.64 $cm^3/g$, achieving good air permeability and high filling power. The data in the table shows that the fabric has good elasticity and high slipping-resistance. Meanwhile, a clear twill-weave pattern, a three-dimensional sense, and tightly interwoven warp and weft yarns are achieved. The novel design of the weave construction makes the handing feeling of the fabric soft and comfortable. When touching the skin, a skin-friendly, comfortable, soft and natural feeling of the fabric is achieved.

It should be understood that the present invention is not limited by the aforesaid embodiments. For those skilled in the art, improvements and modifications may be made based on the specification of the present invention. Therefore, those improvements and modifications shall fall into the scope defined by the claims of the present invention.

What is claimed is:

1. A woven warp-knit-like fabric, comprising:

a first warp yarn, a second warp yarn, a third warp yarn, and a weft yarn, wherein the first warp yarn is interwoven with the weft yarn to form a surface layer of the fabric, the second warp yarn is interwoven with the weft yarn to form a middle layer of the fabric, and the third warp yarn is interwoven with the weft yarn to form an inner layer of the fabric, wherein at least three weft weave points are provided between two adjacent groups of warp weave points on the third warp yarn, and the number of each group of warp weave points is at least one, wherein the first warp yarn is a non-elastic yarn, the third warp yarn is an elastic yarn or a non-elastic yarn, and the elastic properties of the second warp yarn are greater than those of the first warp yarn and the third warp yarn, wherein the second warp yarn is an elastic yarn, wherein the middle layer is a plain weave.

2. The woven warp-knit-like fabric of claim 1, wherein 4-16 weft weave points are arranged between two adjacent groups of warp weave points on the third warp yarn.

3. The woven warp-knit-like fabric of claim 1, wherein the arrangement ratio of the first warp yarn to the third warp yarn is 1:5-4:1, and the arrangement ratio of the first warp yarn to the second warp yarn is 1:4-3:1.

4. The woven warp-knit-like fabric of claim 1, wherein in the surface layer and middle layer, there are 1-7 warp weave points where the warp yarn and weft yarn are interwoven.

5. The woven warp-knit-like fabric of claim 1, wherein the surface layer is a 1/1 plain weave or the number of basic weave cycles is 3-8.

6. The woven warp-knit-like fabric of claim 1, wherein the surface layer is a plain weave, twill weave or satin weave.

7. The woven warp-knit-like fabric of claim 2, wherein 7-13 weft weave points are arranged between two adjacent groups of warp weave points on the third warp yarn.

8. The woven warp-knit-like fabric of claim 1, wherein the first warp yarn is a yarn made of a staple fiber, wherein the second warp yarn is one of an elastic core spun yarn prepared by wrapping an elastic yarn with a staple fiber, a filament yarn with elasticity, and an elastic core spun yarn prepared by wrapping an elastic yarn with a filament yarn, wherein the third warp yarn is one of a yarn made of a staple fiber, a core spun yarn prepared by wrapping an elastic yarn with a staple fiber, and a core spun yarn prepared by wrapping a non-elastic filament yarn with a staple fiber, wherein when the first warp yarn or the third warp yarn is made of a staple fiber, the yarn count ranges from 6S to 60S, wherein when the third warp yarn is a core spun yarn prepared by wrapping an elastic yarn with a staple fiber, the yarn count ranges from 6S to 60S, and the yarn count of the elastic yarn ranges from 20D to 300D, wherein when the third warp yarn is a core spun yarn prepared by wrapping a non-elastic filament yarn with a staple fiber, the yarn count ranges from 6S to 60S, wherein when the second warp yarn is an elastic core spun yarn prepared by wrapping an elastic yarn with a staple fiber, the whole yarn count ranges from 6S to 60S, and the yarn count of the elastic yarn ranges from 20D to 300D, wherein when the second warp yarn is a filament yarn with elasticity, the yarn count ranges from 20D to 450D, and when the second warp is an elastic core spun yarn prepared by wrapping an elastic yarn with a filament yarn, the whole yarn count ranges from 40D to 600D, and the yarn count of the elastic yarn ranges from 20D to 300D.

9. The woven warp-knit-like fabric of claim 1, wherein the English yarn count of the third warp yarn is the same as that of the first warp yarn, or the English yarn count of the third warp yarn is greater than that of the first warp yarn.

10. The woven warp-knit-like fabric of claim 1, wherein the first warp yarn is cotton, and its yarn count ranges from 8S to 38S, wherein the second warp yarn is an elastic core spun yarn prepared by wrapping an elastic yarn with a filament yarn, the whole yarn count ranges from 50D to 150D, and the yarn count of the elastic yarn ranges from 20D to 105D, wherein the third warp yarn is made of a staple fiber, and the yarn count ranges from 16S to 60S, wherein alternatively, the third warp yarn made of a filament yarn, and the yarn count ranges from 50D to 450D.

* * * * *